US008081912B2

(12) United States Patent
Saito et al.

(10) Patent No.: US 8,081,912 B2
(45) Date of Patent: Dec. 20, 2011

(54) IMAGE FORMING APPARATUS WITH MARGINLESS PRINTING MODE

(75) Inventors: Yoshiro Saito, Susono (JP); Keisuke Mitsuhashi, Suntou-gun (JP); Michio Uchida, Susono (JP); Tomonori Shida, Boise, ID (US)

(73) Assignee: Canon Kabushiki Kaisha, Tokyoj (JP)

( * ) Notice: Subject to any disclaimer, the term of this patent is extended or adjusted under 35 U.S.C. 154(b) by 332 days.

(21) Appl. No.: 12/364,757

(22) Filed: Feb. 3, 2009

(65) Prior Publication Data

US 2009/0202279 A1 Aug. 13, 2009

(30) Foreign Application Priority Data

Feb. 8, 2008 (JP) ..... 2008-029744

(51) Int. Cl.
*G03G 15/01* (2006.01)
*G03G 21/00* (2006.01)
*G03G 15/16* (2006.01)

(52) U.S. Cl. ..... 399/298; 399/99; 399/297; 399/299

(58) Field of Classification Search ..... 399/98, 399/99, 297, 298, 299, 302, 313
See application file for complete search history.

(56) References Cited

U.S. PATENT DOCUMENTS

| | | | |
|---|---|---|---|
| 5,666,588 A | 9/1997 | Uchiyama et al. | |
| 5,873,010 A | 2/1999 | Enomoto et al. | |
| 6,564,021 B1 | 5/2003 | Nakai et al. | |
| 6,766,123 B2 | 7/2004 | Ebihara et al. | |
| 6,904,255 B2 * | 6/2005 | Kera et al. | 399/299 |
| 7,206,523 B2 * | 4/2007 | Watanabe et al. | 399/299 X |
| 2007/0025780 A1 * | 2/2007 | Kurosu et al. | 399/313 |
| 2007/0048001 A1 * | 3/2007 | Yamada | 399/99 |
| 2009/0136247 A1 | 5/2009 | Nada et al. | |

FOREIGN PATENT DOCUMENTS

| | | |
|---|---|---|
| JP | 9-152796 A | 6/1997 |
| JP | 10-337886 A | 12/1998 |
| JP | 2001-109325 A | 4/2001 |
| JP | 2001-166558 A | 6/2001 |
| JP | 2005-292296 A | 10/2005 |

* cited by examiner

*Primary Examiner* — Sandra Brase
(74) *Attorney, Agent, or Firm* — Fitzpatrick, Cella, Harper & Scinto

(57) ABSTRACT

An image forming apparatus operates in a marginless print mode in which the toner image is formed on a first region on a first image bearing member corresponding to a sheet size and a second region on the first image bearing member outside the first region. Reverse-transfer efficiency TR1 and reverse-transfer efficiency TR2 satisfy TR1<TR2. TR1 is a percentage of a mass/area, of toner back-transferred from the sheet onto the second image bearing member by a second transfer member to a mass/area, of toner transferred from the first region onto the sheet by a first transfer member. TR2 is a percentage of a mass/area, of toner back-transferred from a sheet feeder onto the second image bearing member by a second transferring means to a mass/area, of the toner transferred from the second region onto the sheet feeder by the first transfer member.

4 Claims, 8 Drawing Sheets

| EVALUATION IMG/TRN RMNDR | RESISTANCE OF BELT (log Ω) | | | | | |
|---|---|---|---|---|---|---|
| | 4 | 6 | 8 | 10 | 12 | 14 |
| RES. OF TRANS RLR (logΩ) | | | | | | |
| 5.5 | MMRY ○ | MMRY ○ | MMRY ○ | MMRY ○ | L. DSTY ○ | L. DSTY × |
| 6 | MMRY ○ | ○ | ○ | ○ | ○ | L. DSTY × |
| 6.5 | MMRY ○ | ○ | ○ | ○ | ○ | L. DSTY × |
| 7 | INTF ○ | ○ | ○ A | ○ | ○ | L. DSTY × |
| 7.5 | INTF ○ | ○ | ○ | ○ | ○ | L. DSTY × |
| 8 | INTF ○ | ○ | ○ | ○ | ○ B | L. DSTY × |
| 8.5 | INTF × | L. DSTY × | L. DSTY × | L. DSTY × | L. DSTY × | L. DSTY × |

Fig. 7

IMAGE FORMING APPARATUS WITH MARGINLESS PRINTING MODE

FIELD OF THE INVENTION AND RELATED ART

The present invention relates to an image forming apparatus for forming a color image, the apparatus having at least two image bearing members, wherein toner images formed on image bearing members are overlaid sequentially on a transfer material carried on a transfer material feeding member, by a transfer member.

Recently, color image forming apparatuses of an electrophotographic type are widely used, and there is a demand for high speed production of the color images in addition to the quality of the color images. To meet such a demand, some proposals have been made. For example, Japanese Laid-open Patent Application 2001-109325 discloses an apparatus, wherein toner images are formed by respective image forming units and are overlaid by transfer means sequentially on a transfer material carried on a transfer material feeding belt (transfer material feeding means) into a color image (tandem color image forming apparatus). In addition, there is an increasing demand for a marginless print as in film photography as a result of wide use of a digital image recording device, such as a digital still camera. Such a marginless print has been put into practice with an ink jet type image forming apparatus disclosed in Japanese Laid-open Patent Application Hei 10-337886, for example, and is desired in the electrophotographic type image forming apparatus.

With such an image forming apparatus of an electrophotographic type capable of a marginless print, no blank need appear on the transfer material even if the transfer material is fed to the transfer station with some positional deviation and even if the transfer material is not completely uniform in size.

It has been proposed that the size of the toner image is made larger than the size of the transfer material, that is, the toner image is larger to extend beyond a first region corresponding to the size of the transfer material, that is, it extends into a second region outside the first region. This result in that toner is transferred onto the transfer material feeding member such as a transfer material feeding belt in the second region, that is, the toner is transferred onto the belt in the second region outside the transfer material.

The size of the outside transferred toner is about 2 mm×210 mm along the short sides in the case of A4 size transfer material.

The size of the outside transferred toner is about 2 mm×297 mm along the long sides in the case of A4 size transfer material.

The excessive toner outside the second area is collected by cleaning means such as a blade, a brush or a roller provided downstream of the transfer portion with respect to the feeding direction of the transfer material feeding belt. In a proposal, the cleaning means is provided with a toner collection container, and the toner is reverse-transferred from the transfer material feeding belt onto the image bearing member, and the toner is collected by the cleaning means.

Such cleaning means is effective to collect a small amount of the toner assuredly, but it may not collect a large amount of toner in a short period. For the case in which a large amount of the toner is to be removed, such as a case immediately after paper jam occurrence or a case in which a control toner image for image density adjustment or for print position adjustment is formed on the transfer material feeding belt, it would be considered to carry out the belt cleaning operation twice or more, with the result of increased number of belt rotations.

It is tolerable to increase the number of rotations of the transfer material feeding belt, for the abnormal cases.

However, in the case of a marginless print, the occurrence of the excessive toner is normal.

In view of continuous printing operations, however, the increase of the number of rotations of the transfer material feeding belt would result in reduction of productivity.

SUMMARY OF THE INVENTION:

According to an aspect of the present invention, there is provided an image forming apparatus, comprising a transfer material feeding member for feeding a transfer material; a first image bearing member for carrying a first toner image; a second image bearing member, provided downstream of the first image bearing member with respect to a feeding direction of the transfer material feeding member, for carrying a second toner image; a first transfer member for transferring the first toner image carried on the first image bearing member onto a transfer material; and a second transfer member, provided downstream of the first transfer member with respect to the feeding direction, for transferring the second toner image carried on the second image bearing member onto the transfer material. The apparatus is operable in a marginless print mode in which the toner image is formed on the first region on the first image bearing member corresponding to a size of the transfer material and a second region on the first image bearing member outside the first region, and wherein a reverse-transfer efficiency $TR1=(P2/P1)\times100(\%)$ and a reverse-transfer efficiency $TR2=(E2/E1)\times100(\%)$ satisfy:

$TR1<TR2$ where the reverse-transfer efficiency TR1 is a percentage of a mass P2 ($g/cm^2$), per unit area, of toner back-transferred from the transfer material onto the second image bearing member by the second transfer member to a mass P1 ($g/cm^2$), per unit area, of toner transferred from the first region onto the transfer material by the first transfer member, and where the reverse-transfer efficiency TR2 is a percentage of a mass E2 ($g/cm^2$), per unit area, of toner back-transferred from the transfer material feeding member onto the second image bearing member by the second transferring means to a mass E1 ($g/cm^2$), per unit area, of toner transferred from the second region onto the transfer material feeding member by the first transfer member.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 7 shows an example of the setting of volume resistivities of a transfer roller and a transfer belt in the present invention.

DESCRIPTION OF THE PREFERRED EMBODIMENTS

The preferred embodiments of the present invention will be described in conjunction with the accompanying drawings.

Embodiment 1

Figure 1:
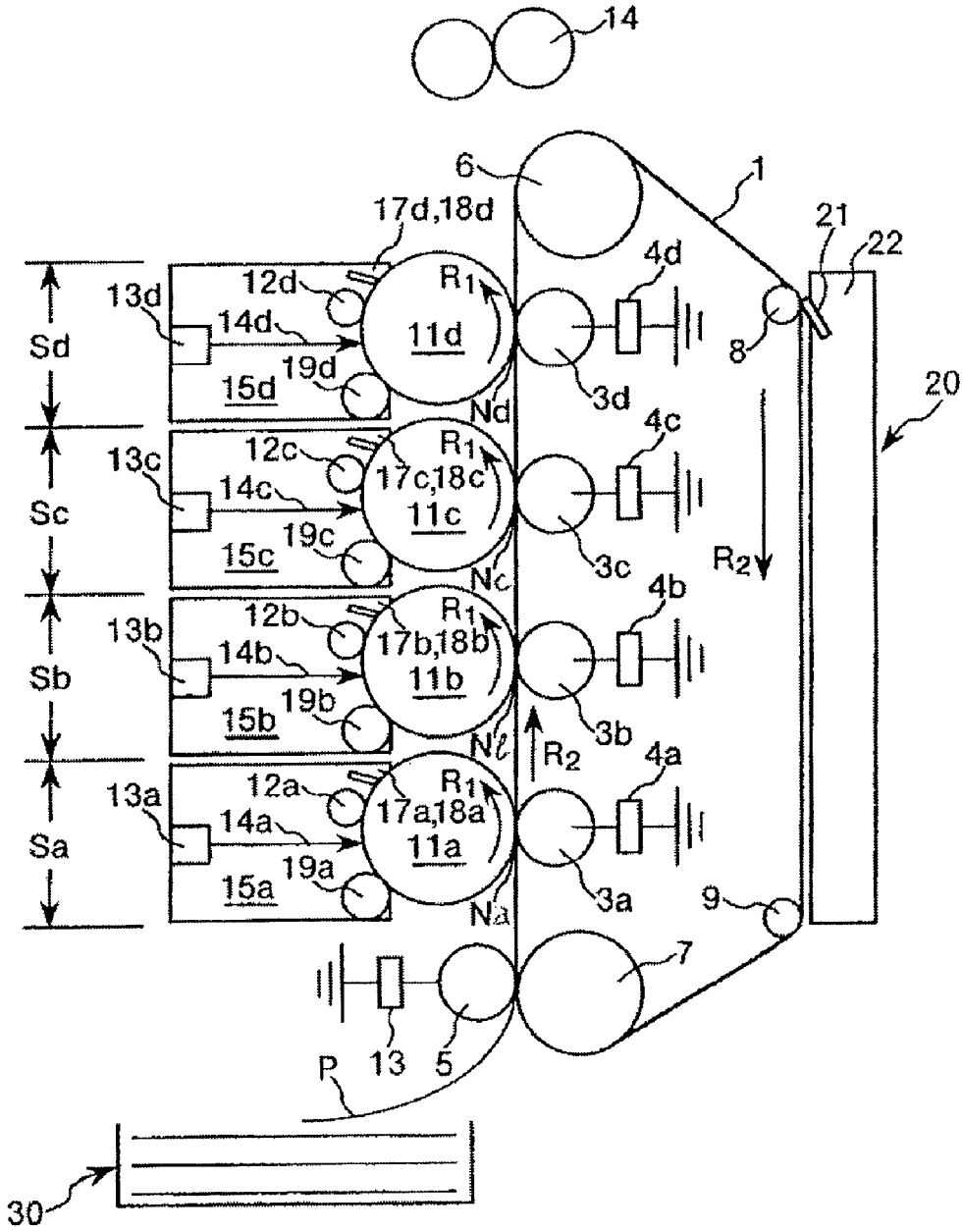
FIG. 1 illustrates a general arrangement of an image forming apparatus according to the present invention.

FIG. 1 shows a general arrangement of a tandem type color image forming apparatus which is an embodiment of the image forming apparatus according to the present invention. The structure of the image forming apparatus is complicated and downsizing is desired. The image forming apparatus is classified according to various types. In an example, the toner images formed on the image bearing members are superimposedly transferred onto an intermediary transfer member, and a color toner image is provided by this (superimposing transfer type). In another example, the color images are superimposedly formed on the surface of one image bearing member, and thereafter, the color images are transferred altogether (superimposing development type). In a further example, the image forming means (process stations) of the different colors are provided in series, and the toner images are transferred onto the transfer material fed by transfer material carrying means (in-line type).

The color image forming apparatus of the present embodiment is the color image forming apparatus of the in-line type. It has four image forming stations (the image formation stations S (Sa, Sb, Sc, Sd)) which are perpendicularly arranged in the present embodiment (the so-called color image forming apparatus of the tandem type). The four image formation stations Sa, Sb, Sc, and Sd are the yellow (Y), magenta (M), cyan (C), and black (Bk) image formation stations arranged in the order named from upstream with respect to the transfer material carrying direction of the transfer material conveying belt 1 as the transfer material feeding member. The image formation stations Sa, Sb, Sc, and Sd have the same structures.

Figure 2:
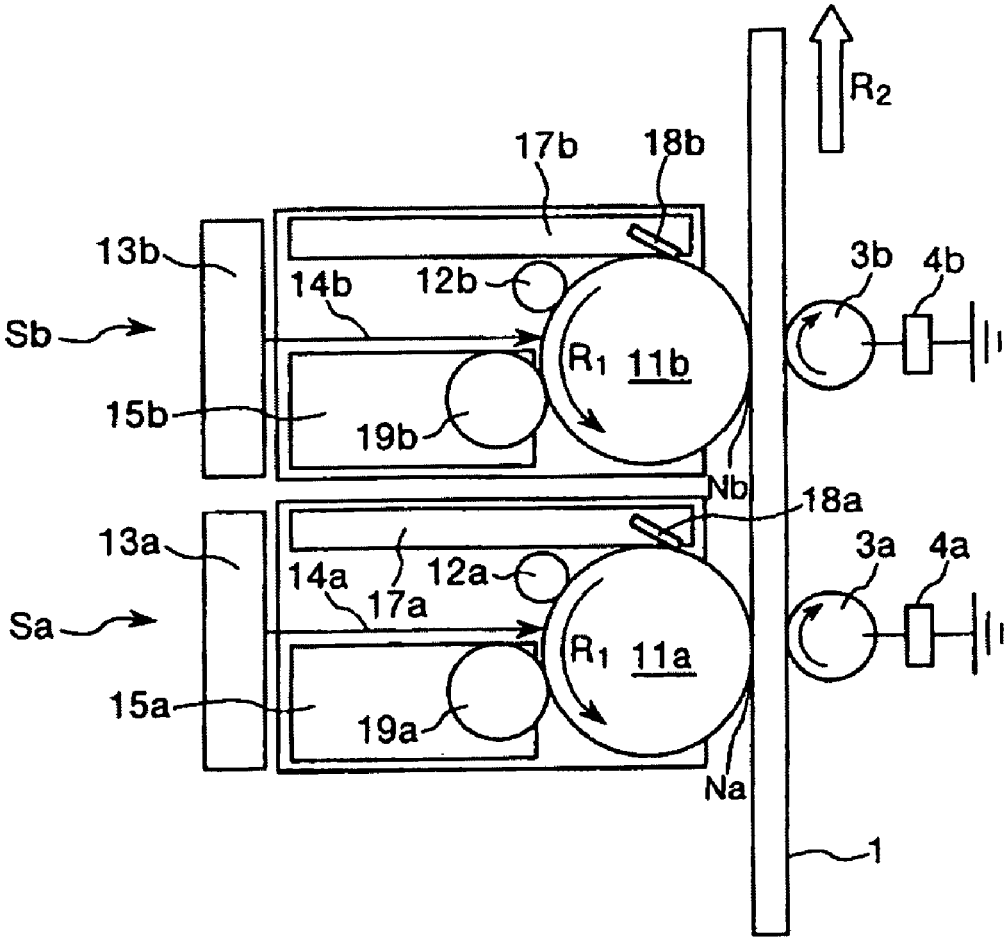
FIG. 2 illustrates an image forming station of the image forming apparatus according to the present invention.

FIG. 2 illustrates the yellow image forming station Sa and the magenta image forming station Sb in an enlarged scale.

Referring to FIGS. 1 and 2, each image formation station S is provided with an electrophotographic photosensitive member (photosensitive drum) 11 (11*a*, 11*b*, 11*c*, 11*d*) in the form of a drum as the image bearing member, and the photosensitive drum 11 is rotatable in the direction of the arrow R1. A charging roller 12 (12*a*, 12*b*, 12*c*, 12*d*) and an exposure device 13 (13*a*, 13*b*, 13*c*, 13*d*) are provided in the order named along the rotational direction around each photosensitive drum 11.

Furthermore, a developing device 15 (15*a*, 15*b*, 15*c*, 15*d*) is provided downstream with respect to the rotational direction of the photosensitive drum around the photosensitive drum 11. In addition, a transfer member 3 (3*a*, 3*b*, 3*c*, 3*d*) and a cleaning device 17 (17*a*, 17*b*, 17*c*, 17*d*) are provided downstream with respect to the photosensitive drum rotational direction around the photosensitive drum 11.

The photosensitive drum 11 as the image bearing member may comprise a cylindrical drum of aluminum, and an OPC (organic optical semiconductor) layer as a photosensitive layer on the surface thereof. The charging roller 12 is contacted to the surface of the photosensitive drum 11, and it is supplied with a charging bias voltage from an unshown charging bias voltage applying source. By this, the surface of the photosensitive drum 11 is uniformly charged to a predetermined potential in a predetermined polarity. The exposure device 13 includes a scanner unit or an LED array for deflecting the laser beam oscillated in response to the image information by a polygon mirror. The exposure device 13 scans the surface of the charged photosensitive drum 11 by the scanning beams 14 (14*a*, 14*b*, 14*c*, 14*d*) modulated on the basis of the 8-bit image signals (00h-FFh (h expresses the hexadecimal)). By this, the charge of the portion exposed to the beam is removed, so that an electrostatic latent image is formed. In this embodiment, when the image signal is 00h, the solid white image is formed, and the solid black image is formed when it is FFh.

Each developing device 15 deposits the toner on the developing sleeve 19 (19*a*, 19*b*, 19*c*, 19*d*) which is the developer carrying member on the electrostatic latent image on the photosensitive drum 11 surface to develop it into a visualized toner image of each color.

Each transfer roller 3 which constitutes the transfer member has the function of electrostatically transferring, onto the transfer material P on the transfer material conveying belt 1, the toner image formed on the photosensitive drum 11. As the material of the transfer roller 3, rubber materials, such as EPDM, urethane, NBR, epichlorohydrine, and silicone, are usable. In this embodiment, the transfer roller 3 includes the core metal having 6 mm in diameter, and the elastic layer having a thickness of 3 mm thereon. As the elastic layer, NBR and epichlorohydrine are blended so that the six kinds of elastic layers which have volume resistivities of (ρT) $10^{5.5}$, $10^{6}$, $10^{6.5}$, $10^{7}$, $10^{7.5}$, $10^{8}$, and $10^{8.5}$ Ω-cm, respectively were prepared. They have Asker C hardnesses of 30 degrees.

The transfer roller 3 is disposed inside of the transfer material conveying belt 1, presses the transfer material conveying belt 1 to the photosensitive drum 11 surface with pressure, so as to form a transfer nip N (Na, Nb, Nc, Nd) between the photosensitive drum 11 and the transfer material conveying belt 1. In this embodiment, a contact pressure to the photosensitive drum 11 of the transfer roller 3 is 2.0 g/mm. In this embodiment, each transfer roller 3 is connected with a transfer bias application voltage source 4 (4*a*, 4*b*, 4*c*, 4*d*) as a constant voltage source. It may be a constant-current source. A photosensitive drum cleaning device 17 (17*a*, 17*b*, 17*c*, 17*d*) as a cleaning member has a cleaning blade 18 (18*a*, 18*b*, 18*c*, 18*d*) for removing the toner which remains on the surface of the photosensitive drum 11 without transferring onto transfer material P.

In each of the above-described image formation stations S, the developing device 15 is in the form of a developing unit, and the cleaning device 17 is constituted as the drum unit with the photosensitive drum 11 and the charging roller 12. These developing units and the drum unit may be in the form of a cartridge which can be detachably mountable to the main assembly of the image forming apparatus, respectively. The developing unit and the drum unit can also be constituted as one process cartridge.

The transfer material conveying belt 1 as a transfer material conveyance member is extended around the four rollers 6, 7, 8, and 9, and is rotated at a predetermined speed (process speed of 100 mm/s in the present embodiment) in the arrow R2 direction. In this manner, the transfer material conveying belt 1 feeds the transfer material P carried by the surface thereof sequentially to the image formation station S (Sa, Sb, Sc, Sd).

For the cleaning of the transfer material conveying belt 1, a transfer material feeding belt cleaning device 20 as the means to remove unnecessary toner on the surface thereof is provided. The transfer material feeding belt cleaning device 20 is provided with a scraping blade 21 and a container 22 which stores the toner collected by the blade 21 shown in FIG. 1, in the present embodiment.

The transfer material feeding belt cleaning device 20 is not limited to the scraping type of the present embodiment which uses the blade 21. The rollers, such as a fur-brush roller and a sponge roller, may be used in place of the blade 21, for example, and a peripheral speed difference may be provided relative to the transfer material conveying belt 1 (rubbing-off type). In order to utilize the potential difference, these toner recovery means may be supplied with the bias.

The transfer material conveying belt 1 may be made of resin film, such as PVdF, ETFE, polyimide, PET, polycarbonate or the like resin material, which have about 50-300 micrometers in thickness. Alternatively, it may include a base layer of the EPDM or the like rubber, for example, which has about 0.5-2 mm in thickness, and a urethane rubber surface layer in which fluorinated resin material, such as PTFE, for example, is dispersed, thereon. An electroconductive filling material of carbon, ZnO, SnO2, and TiO2 or the like may be dispersed in this material to adjust the volume resistivity. In this embodiment, the six kinds of the volume resistivities (pH) $10^6$, $10^8$, $10^{10}$, $10^{12}$, and $10^{14}$ and $10^{16}$ Ω-cm are prepared, and they are made of PVdF or the like which has a thickness of 100 micrometers.

The volume resistivity of the transfer material conveying belt 1 is measured by the method stipulated in JIS-K6911. The satisfactory contact property between the electrode and the belt surface is provided by using the electrode of electroconductive rubber. A Resistivity Meter (available from Mitsubishi Chemical Analytech Co., Ltd, Hiresta UP) is used. The measuring condition is such that the applied voltage=100V, the voltage applying duration=10 s.

Transfer material P is fed to the transfer material conveying belt 1 by supplying and feeding device 30. The attraction roller 5 electrostatically attracts the transfer material P fed from the supplying and feeding device 30 to the transfer material conveying belt 1 surface. The attraction roller 5 includes a metal core, for example, and an electroconductive elastic member of EPDM, urethane rubber, and NBR or the like, which have a volume resistivity of about $10^5$ to $10^8$ Ω-cm thereon. It further includes an intermediate layer, such as a urethane layer with a thickness of about 200-600 micrometers, thereon. It further includes a surface layers layer, such as the styrene layer of about 250-micrometer thickness.

The attraction roller 5 is urged toward the roller 7 through the transfer material conveying belt 1 by pressing metal core portions provided in opposite ends of the attraction roller 5 by the spring with about 0.04-0.5-N line pressure. By this, it is rotated by the movement of the transfer material conveying belt 1. In this manner, an attraction nip is constituted between the attraction roller 5 and the roller 7.

In this embodiment, the attraction roller 5 is connected with an attraction bias voltage applying source 13 as the constant voltage source.

In a further downstream part, with respect to the transfer material carrying direction, of the roller 6 disposed at the most downstream side of the transfer material conveying belt 1, a fixing device 14 for fixing the toner image transferred onto the surface of transfer material P is disposed.

When an image forming operation starts in the image forming apparatus having the above-described structure. The photosensitive drum 11 (11*a*, 11*b*, 11*c*, 11*d*) and the transfer material conveying belt 1 begin rotating in the arrow R1 direction and the arrow R2 direction with the predetermined process speed, respectively. Simultaneously, the exposure device 13 (13*a*, 13*b*, 13*c*, 13*d*) starts. The photosensitive drum 11 is uniformly charged to the predetermined potential of the predetermined polarity by the charging roller 12.

On the other hand, the transfer material P contained in a sheet feeding cassette 30 as the supplying and feeding device is fed to the attraction roller 5 by the sheet feeding cassette. The transfer material P is electrostatically attracted on the transfer material conveying belt 1 surface by the voltage applied between the attraction roller 5 and the roller 7. At this time, in the yellow image forming station Sa, the electrostatic latent image is formed on the surface of a photosensitive drum 11*a* in accordance with image information by scanning beam 14*a* from the exposure device 13*a* synchronized with the feeding of transfer material P. With the further rotation of the photosensitive drum 11*a*, the electrostatic latent image is developed with toner by the developing sleeve 19*a*, and is visualized into a yellow toner image. The toner image on the photosensitive drum 11*a* is transferred by the transfer bias voltage for the image formation applied to the transfer roller 3*a* by the transfer bias application voltage source 4*a* onto the transfer material P attracted and fed by the transfer material conveying belt 1.

Also in the image formation stations Sb, Sc, and Sd, the respective color toner image is formed on the photosensitive drums 11*b*, 11*c*, and 11*d* similarly to the image formation station Sa of the yellow. The toner images on the photosensitive drums 11*b*, 11*c*, and 11*d* are superimposedly transferred by the transfer member onto the transfer material P in synchronism with the feeding by the transfer belt 1 of the transfer material P. In this manner, a toner image which has the yellow, magenta, cyan, and black images superimposedly on the transfer material P is formed. The transfer material P after the transferring of the toner image is separated from the transfer material conveying belt 1, and, thereafter, is heated and pressed by the fixing device 14, and the toner image is fused and fixed on the surface.

On the other hand, the toner which remains on the surface without transferring onto the transfer material P is removed by the respective photosensitive drum cleaning devices 17 from the photosensitive drums 11 (11*a*, 11*b*, 11*c*, 11*d*) after the toner image transferring. Thereafter, the photosensitive drums 11 are prepared for the next image formation.

From the transfer material conveying belt 1, the unnecessary toner which remains is removed by the cleaning blade 21 of the transfer belt cleaning device 20, and is prepared for the feeding of the next transfer material P.

Figure 3:
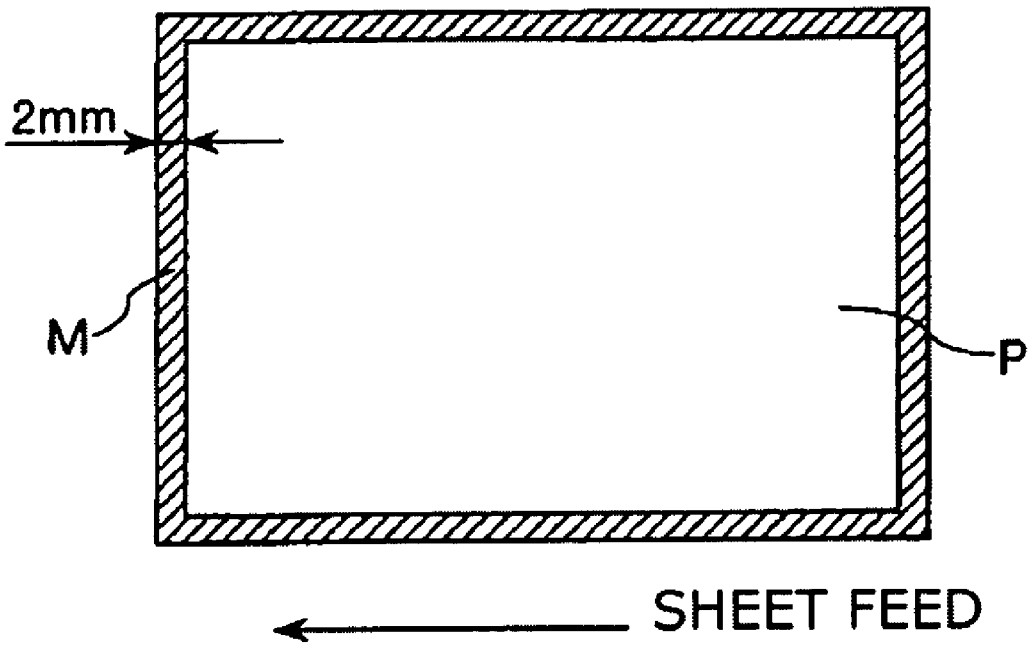
FIG. 3 illustrates a marginless print according to the present invention.

The image forming apparatus of the present embodiment is operable in a marginless print mode which can form a marginless image which does not have a blank at least at one edge of the transfer material P. As shown in FIG. 3, in the marginless print mode, the image which does not have the marginal blank portion at all four sides of the transfer material can be printed by forming the toner image in larger region (the 2nd region M) than the region (the 1st region) corresponding to the transfer material on the image bearing member.

In other words, by extending the toner image beyond the region of the transfer material P, the toner image can be formed to the extent of the edges of the transfer material P eve even with some positional deviation of the transfer material P.

In this embodiment, the second region M in the marginless print mode is defined at 2 mm outside of the each of the four edges of the transfer material P.

In the marginless print mode, the toner image formation area of the image bearing member is wider than usual, it is necessary to enlarge the image data. This is accomplished by the user making the image having a size larger than the size of the transfer material using a software application.

Alternatively, it is accomplished by the controller enlarging the image data with the predetermined magnification or repeating the data of the outermost periphery of the image data to provide the enlarged portion.

In this manner, the marginless print is possible by increasing the toner image area on the image bearing member than the region corresponding to the transfer material.

On the other hand, as for the toner transferred on the transfer material conveying belt 1 without transferring onto the transfer material from the 2nd region on the image bearing member, it is desired to remove assuredly by the transfer material feeding belt cleaning device 20, in the marginless print mode operation. Otherwise, it appears as toner soiling the back side and the edge portion of the next transfer material. In order to carry out the cleaning assuredly, the present embodiment selects the volume resistivities of the transfer roller 3 and the transfer belt 1, by which before reaching the cleaning device 20, a part of the toner on the transfer belt 1 is collected by the photosensitive drum 11. By this, the load of the cleaning device 20 is reduced.

Figure 4:
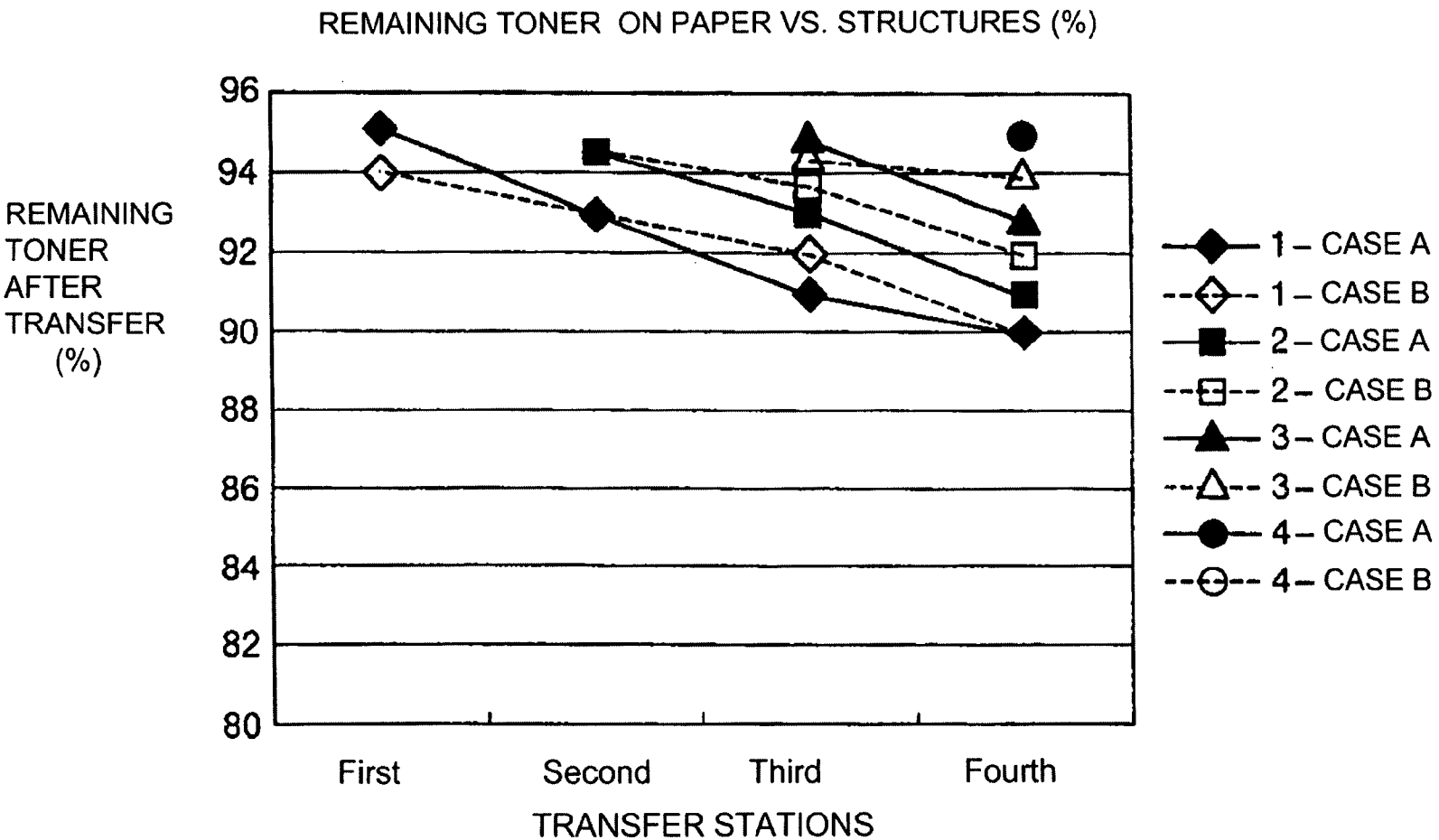
FIG. 4 illustrates a remaining amount of toner on a transfer material after the transferring.

FIG. 4 shows the plots of the percentage of the amount of the toner transferred on transfer material relative to the amount of the toner image formed on the photosensitive drum 11 after passing the downstream transferring station (transfer nip part N) with respect to the transfer material carrying direction (transfer material conveying belt movement direction), for each of the image transfer stations. The transfer material used is the color laser copying apparatus sheet available from Canon, Inc. (the volume resistivity of $10^{11}$ Ω-cm at 25 degree C. and 50% of the humidity, the basis weight of 81.4 g/m$^2$, A4 size). The volume resistivity of the transfer material is measured similarly to the volume resistivity of the transfer material conveying belt.

In the Case A shown with the solid-black dots and the solid line, the volume resistivity of the transfer material conveying belt 1 is $10^8$ Ω-cm, and the volume resistivity of the transfer roller 3 is $10^7$ Ω-cm.

In the Case B shown with the hollow dots and the broken line, the volume resistivity of the transfer belt 1 is $10^{12}$ Ω-cm, and the volume resistivity of the transfer roller 3 is $10^8$ Ω-cm. This graph shows that there is no large difference between Case A and Case B. In the case of the combination of the volume resistivities in Case A, the volume resistivities of the transfer material conveying belt 1 and the transfer roller 3 are significantly low as compared with volume resistivity $10^{11}$ Ω-cm of the transfer material. Therefore, the large transfer current tends to flow in the area outside the transfer material.

In the case of the combination of Case B, the volume resistivity of the transfer roller is high, and the volume resistivity of the transfer material conveying belt is also high as compared with volume resistivity $10^{11}$ Ω-cm of the transfer material. Therefore, the transfer current equivalent to the portion with the transfer material flows through the area outside the transfer material. In FIG. 4, the influence of the volume resistivity of the transfer material is dominant to the transfer current in the portion having the transfer material, and, therefore, there is no significant difference between Case A and Case B.

Figure 5:
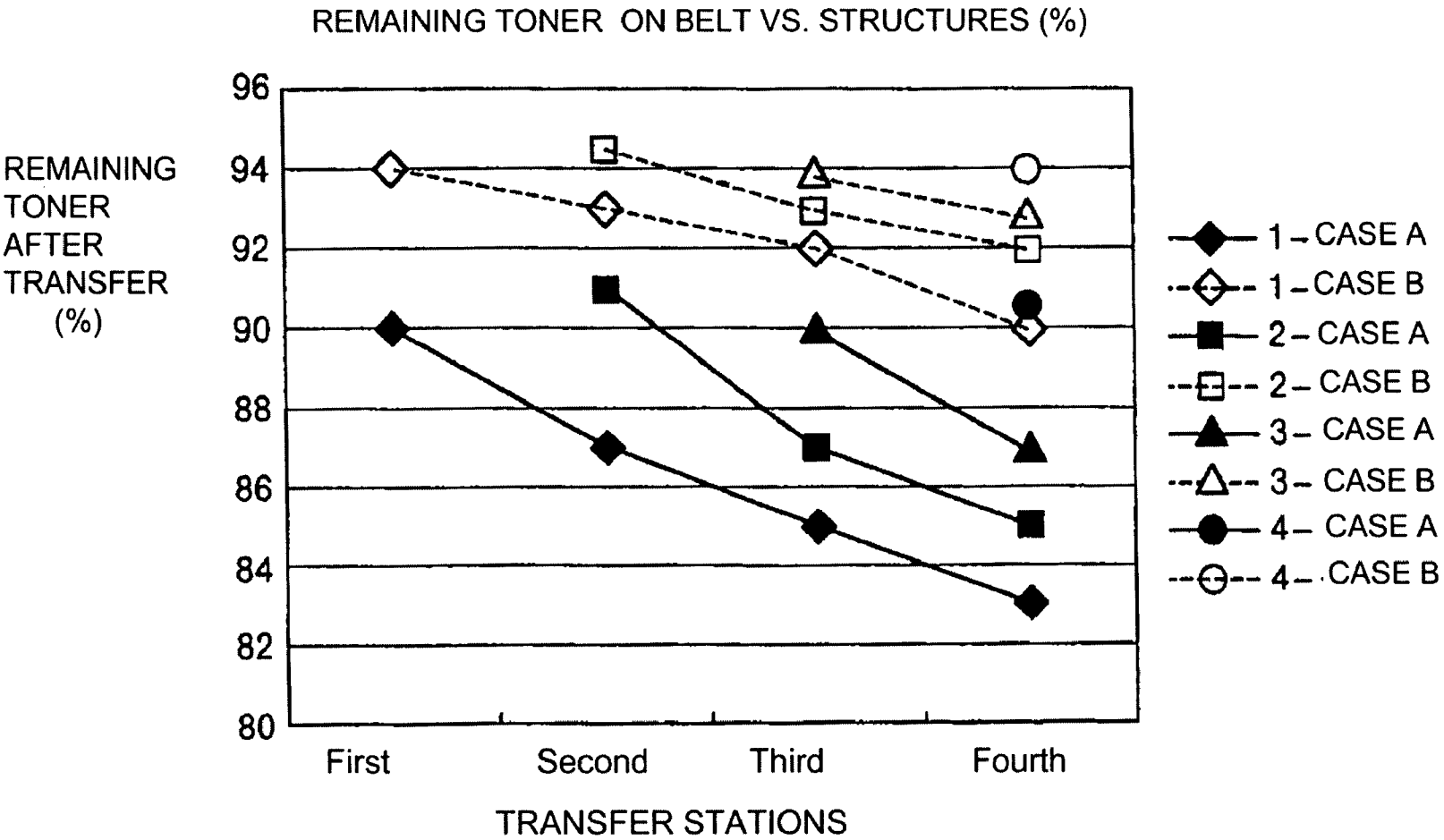
FIG. 5 illustrates a remaining amount of the toner on a transfer material conveying belt after the transferring.

On the other hand, FIG. 5 shows the plots of the data obtained simultaneously with FIG. 4 data, and are the plots of the transfer efficiency of the toner transferred on the transfer material conveying belt 1 in the outside area of the transfer material, namely the toner transferred on the transfer material conveying belt 1 from the second region on the image bearing member. With reference to FIG. 5, in the Case A shown with the black dots and the black solid line, the values are low over the region from the most upstream side to the downstream as compared with the Case B shown with the hollow dots and the broken line. In other words, as for the toner transferred onto the transfer material conveying belt 1, in Case A, the toner transfer efficiency to the transfer material conveying belt 1 from the photosensitive drum 11 is low, and the remaining amount of the toner after passing the downstream transferring station is also small, in other words, total transfer efficiency is poor.

The following is understood from the result of FIG. 4 and FIG. 5: The image transferred on the transfer material in Case B does not have the defect, but there is a larger amount of the toner which remains on the belt after passing all the transferring stations among the toner transferred on the transfer material conveying belt 1 from the second region on the image bearing member as compared with Case A. Therefore, as for Case B, as compared with Case A, a larger amount of the toner has to be removed by the cleaning device 20 of the transfer material conveying belt 1. This increases the duty of the cleaning device 20.

On the other hand, in Case A, the image does not have the defect and there is a smaller amount of the toner transferred onto the transfer material conveying belt 1 than in Case B. In addition, the amount which will be collected by the photosensitive drum from the toner transferred onto the transfer material conveying belt 1 by the time it passes the fourth station is larger than the amount in Case B, and therefore, the duty of the cleaning device 20 is significantly small.

In this manner, the structure of Case A provides the low transfer efficiency to the transfer material conveying belt 1, wherein the toner is easily transferred inversely onto the photosensitive drum 11 from the transfer material conveying belt 1 at the time of passing the downstream transferring station. The reason therefor will be described referring to FIG. 6.

Figure 6:
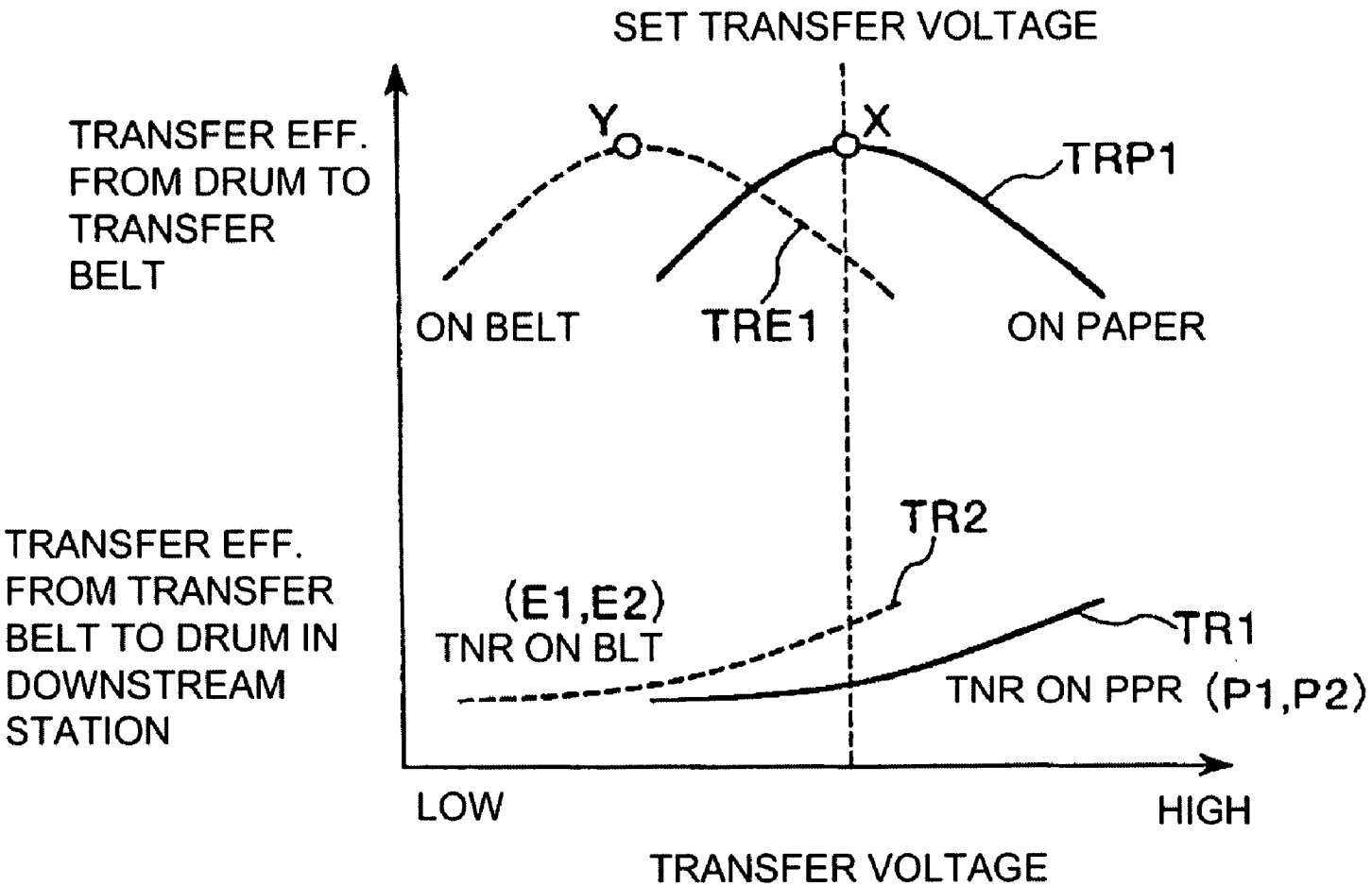
FIG. 6 illustrates an example of setting of a transfer voltage in the present invention.

In FIG. 6, the abscissa represents the voltage set point of the transfer bias voltage, and the ordinate represents transfer efficiency. Here, the upstream photosensitive drum with respect to the feeding direction of transfer material conveying belt is called the first photosensitive drum 11 (first image bearing member), and the downstream photosensitive drum the first photosensitive drum 11 is called the second photosensitive drum (second image bearing member). The image transfer efficiency is the percentage of mass (g/cm$^2$) of the toner per unit area in the toner image on the transfer material after the image transferring relative to mass (g/cm$^2$) of the toner per unit area in the toner image which the first photosensitive drum carries. The two upper convex-up lines are the plots of the toner transfer efficiency from the photosensitive drum 11 to the transfer material conveying belt 1 relative to the transfer voltage. In the case of the plots shown by the solid line, the highest transfer efficiency to the transfer material (paper) occurs by the set point X.

On the other hand, in the case of the plots shown by the broken line, the highest transfer efficiency to the transfer material conveying belt 1 occurs at the set point Y, and the transfer efficiency is relatively low at the set point X.

Here, a transfer efficiency, to the transfer material, of the toner image formed on the photosensitive drum 11 by the developing device 15 is TRP1. A transfer efficiency, to the outside area of the transfer material on the transfer material conveying belt 1, of the toner image formed on the second region of the photosensitive drum 11 is TRE1.

The toner mass (g/cm$^2$) per unit area of the toner image formed on first region and second region of the photosensitive drum 11 is P0. The toner mass (g/cm$^2$) per unit area of the toner image transferred onto the transfer material from the first region of the photosensitive drum 11 is P1. The toner mass per unit area of the toner image transferred onto the outside area of the transfer material on the transfer material conveying belt 1 from the second region of the photosensitive drum 11 is E1 (g/cm$^2$).

Then, $$\text{Transfer efficiency } TRP1=(P1/P0)\times 100(\%)$$

$$\text{Transfer efficiency } TRE1=(E1/P0)\times 100(\%)$$

In this embodiment, the transfer efficiency TRP1 and the transfer efficiency TRE1 satisfy the following relation:

TRP1>TRE1.

The reason will be described.

With the volume resistivity setting of the transfer roller 3 and the transfer belt 1 of Case A in FIG. 4, the resistance of the portion in which the transfer material is not present is relatively low as compared with the portion in which the transfer material is present. Therefore, with the same transfer voltage set point, the transfer current in the area in which the transfer material is not present is larger. As a result, with the transfer voltage set point optimal relative to the transfer material, the transfer current relative to the transfer material conveying belt 1 is excessive, and the transfer current is at such a level as results in abnormal discharge partially. Therefore, the transfer current does not contribute to the movement of the toner, but moreover, the charge of the toner is attenuated or it is made to revert. As a result, it is thought that the function of making the toner correctly respond to the transfer bias voltage is suppressed.

In the downstream transferring station formed with the second photosensitive drum and the second transfer roller on the other hand, the toners transferred onto the transfer material from the first photosensitive drum hardly reverse-transfer to the photosensitive drum 11. This is because the correct current flows in the portion in which the transfer material presents.

However, the optimal transfer bias voltage relative to the transfer material causes abnormal discharge relative to the toner on the transfer material conveying belt 1. Therefore, the potential of the toner on the transfer material conveying belt 1 further attenuates, or the reversion is promoted, and as a result, reverse transfer is promoted further.

Here, the toner P1 transferred onto the transfer material by the upstream first transfer roller 3 with respect to the transfer material carrying direction of the transfer material conveying belt 1 is reverse-transferred onto the second photosensitive drum 11 by the downstream second transfer roller 3 (toner P2) according to a reverse transfer ratio TR1. The toner E1 transferred onto the outside area of the transfer material by the upstream first transfer roller 3 with respect to the feeding direction of the paper on the transfer belt 1 is reverse-transferred onto the second photosensitive drum 11 by the downstream second transfer roller 3 (toner E2) according to a reverse transfer ratio TR2. In other words, P1, P2, E1, and E2 are the masses (g/cm$^2$) of the toner per unit area, and the reverse transfer ratios TR1 and TR2 are, $$TR1=(P2/P1)\times 100(\%)$$

$$TR2=(E2/E1)\times 100(\%).$$

According to this embodiment, the reverse transfer ratio TR1 and the reverse transfer ratio TR2 satisfy the following relation:

TR1<TR2

With this structure, even when the toner image on the second region of the first image bearing member is transferred onto the transfer material conveying belt by the first transfer roller, the toner transferred onto the transfer material conveying belt is easy to reverse-transfer onto the second image bearing member by the second transfer roller. Therefore, the high-quality image not having the contamination due to improper cleaning can be continuously outputted without the reduction of the speed.

FIG. 7 shows the results of experiments similar to those of FIG. 4 with different resistances of the transfer roller 3 and the transfer belt 1. In FIG. 7, the upper line shows the results of the evaluation of image in the respective volume resistivity settings. The lower stage is the evaluation of the collection, by the downstream transferring station, of the toner on the transfer material conveying belt 1. The evaluation is "G (o)" in the case where the load of the transfer belt cleaning device 20 is reduced. The evaluation is "N (x)", in the case where the toner on the belt is hardly collected at the downstream transferring station and the cleaning duty is large. FIG. 7 shows the measurements of the remainder amounts of the toner on the transfer material conveying belt 1.

Here, the image defect in FIG. 7 will be described.

<Memory>

In FIG. 7, in the case of the volume resistivities of the transfer roller 3 and the transfer material conveying belt 1 being very low, the resistance difference between the portion which has the transfer material, and the portion which does not have the transfer material is very large. Therefore, the transfer current concentrates on the portion which does not have the transfer material. As a result, the excessive transfer current flows into the portion of the photosensitive drum 11 contacted to the portion of the transfer material conveying belt 1 which does not have the transfer material, and, therefore, the transfer memory occurs in the photosensitive drum 11. Due to this transfer memory, the potential on the photosensitive drum 11 becomes always lower than the other portion. Intense toner soiling (background fog) occurs in the portion which does not have the transfer material on the transfer material conveying belt 1 by repeating it further. The edge of the following paper is contaminated by this background fog, and the toner is consumed vainly.

<Interference>

In FIG. 7, in the case that the volume resistivity of the transfer material conveying belt 1 is very low and the volume resistivity of the transfer roller 3 is relatively high, the production of memory can be prevented by resistance of the transfer roller 3. However, the transfer current flows mutually between the adjacent transferring stations along the surface of the transfer material conveying belt 1, with the result of the interference therebetween. As a result, the horizontal stripe image appears at the timing at which the transfer bias voltage of the adjacent transferring station is rendered on, or the timing at which it is rendered off, or the image density changes there.

<Insufficient Image Density>

In FIG. 7, when resistance of one or both of the transfer material conveying belt 1 and the transfer roller 3 are high, the transfer current will be insufficient, and the toner is not sufficiently transferred.

As a result, the light image is particularly roughened, or the dark image also becomes lighter in the worst case.

<"G" Part>

Referring to FIG. 7, when the resistances of the transfer roller 3 and the transfer belt 1 are proper, the above image defects do not occur and the images with satisfactory tolerance are provided.

This is a range surrounded by the solid line in FIG. 7, and in this range, the load (duty) of the cleaning device 20 is reduced. In this range, the volume resistivity (ρT) of the transfer roller 3 is $10^6$-$10^8$ Ω-cm, and the volume resistivity (ρH) of the transfer material conveying belt 1 is $10^6$-$10^{12}$ Ω-cm.

More particularly, in the case of the volume resistivity (ρT) of the transfer roller 3 and the volume resistivity (ρH) of the transfer material conveying belt 1 being lower than the volume resistivity of the transfer material, it is easy to flow the abnormal current into the portion which does not have the transfer material. Therefore, it becomes easier to produce the reverse-transfer onto the second photosensitive member.

In other words, the second photosensitive drum can collect easily the toner image transferred onto the transfer material conveying belt from the first photosensitive drum 11.

More particularly, by using the transfer material conveying belt 1 and the transfer roller 3 which are set to the volume resistivity within the limits surrounded with the solid lines in FIG. 7, the high quality of the image is maintained as far as the edge of the transfer material, and a part of the toner which is not transferred onto the transfer material is easily collected onto the photosensitive drum 11. Therefore, the load required by the cleaning member 21 is eased.

As a result, the amount of the toner which is not removed by the cleaning member 21 in operation in marginless print mode is reduced, and the toner on the transfer material conveying belt 1 is assuredly removed by one cleaning operation. Therefore, the high-quality image not having the contamination attributable to the improper cleaning can be continuously outputted without the reduction of the speed.

In this embodiment, although the blade 21 is used as the cleaning device 20 for the transfer material conveying belt 1, the toner may be physically scratched by a known brush and known roller.

As the cleaning device 20 of the transfer material conveying belt 1, the means for collecting the toner onto the photosensitive drum 11 by charging the toner on the transfer belt 1 by the known charging means may be employed.

Alternatively, the peripheral speed difference may be provided between the photosensitive drum 11 and the transfer material conveying belt 1, and the toner may be collected onto the photosensitive drum 11 by applying the transfer bias voltage in the opposite direction. The toner collected onto the photosensitive drum 11 is removed from the photosensitive drum 11 by the cleaning device 17 for the photosensitive drum. These means may be combined properly.

Embodiment 2

Also in this embodiment, the image forming apparatus has the structure similar to the forgoing embodiment described referring to FIGS. 1 and 2. Therefore, the description of the general arrangement of the image forming apparatus is omitted for simplicity.

The toner amount which remains on the transfer material conveying belt 1 after all the transferring station passages is controlled by controlling the volume resistivity of the transfer member, and the volume resistivity of the transfer feeding member in Embodiment 1. In this embodiment, the toner amount which remains on the transfer material conveying belt 1 is controlled by controlling the hardness of the transfer roller 3 and the contact pressure against the transfer material conveying belt 1.

Figure 8:
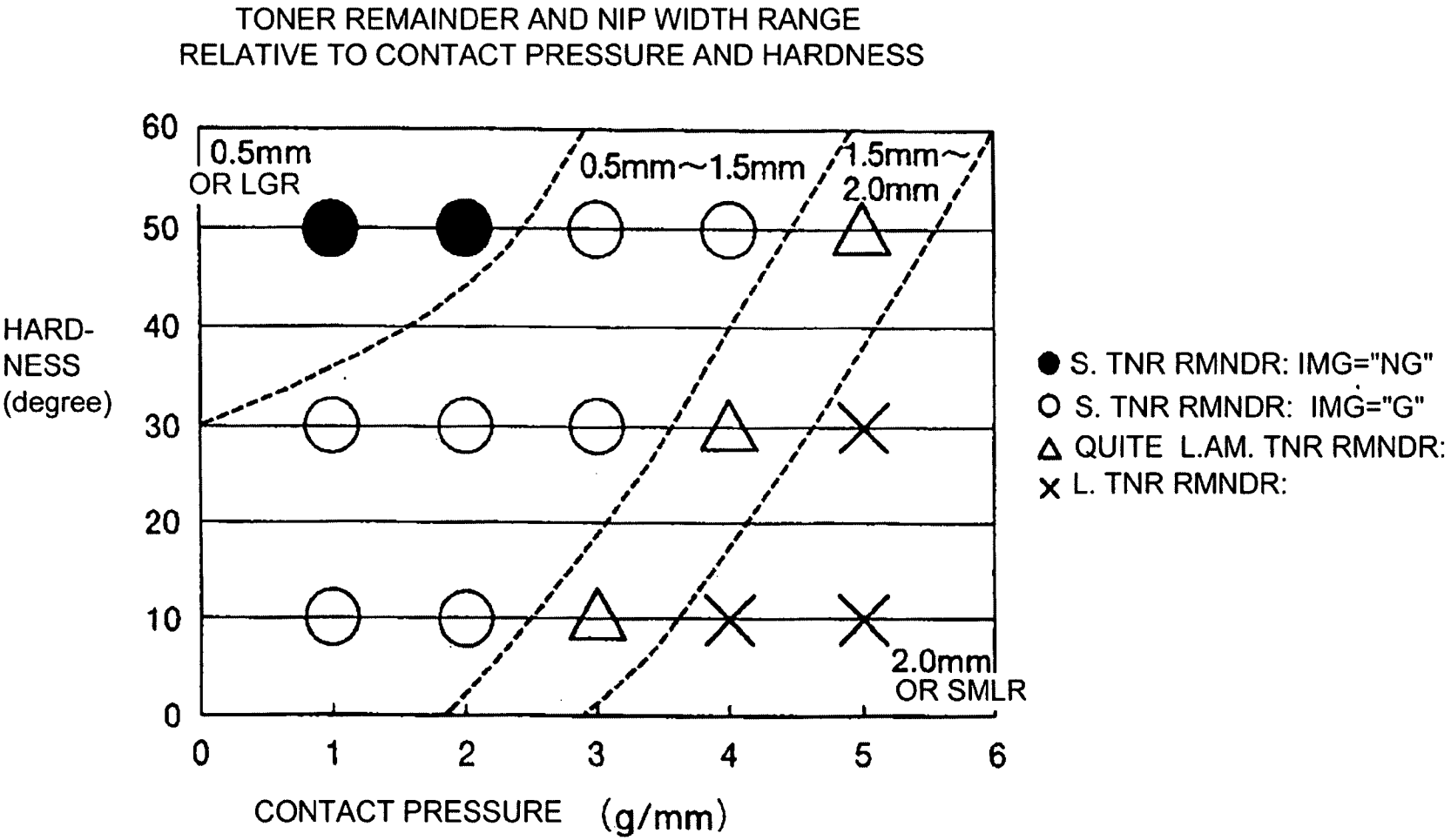
FIG. 8 illustrates an example of setting of a width of a nip in the present invention.

FIG. 8 shows results of the experiments in which the images and the toner amounts which remain on the transfer material conveying belt 1 were measured with different hardnesses of the transfer roller 3 and different spring pressures for pressing the transfer roller 3, using the image forming apparatus similar to Embodiment 1. Here, the volume resistivity of the transfer roller 3 is $10^7$ Ω-cm, and the volume resistivity of the transfer material conveying belt 1 is $10^8$ Ω-cm.

The value of the width (nip width NW) of a nip N shown in FIG. 8 is determined as follows.

The image forming apparatus is once stopped in the state where the solid black toner image is formed on the photosensitive drum 11. Then, in the state where the transfer material conveying belt 1 is spaced from the photosensitive drum 11, the photosensitive drum 11 is rotated until the phase in which the toner on the photosensitive drum 11 contacts to the transfer material conveying belt 1 is reached. The transfer material conveying belt 1 is contacted to the photosensitive drum 11, and then only the transfer belt 1 is moved. The width on the photosensitive drum 11 with which the toner was scratched by the transfer material conveying belt 1 is measured. This value is determined as the transfer nip width (NW).

The respective cases in FIG. 8 will be described.

<"N" (Solid Dot)>

In the range which contains solid dots in FIG. 8, the hardness of the transfer roller 3 is very high and, on the other hand, the pressure of the transfer roller 3 is low. With such a setting, the width (NW) of the nip provided between the transfer material conveying belt 1 pressed against the transfer roller 3 and the photosensitive drum 11 is not sufficient.

The width (NW) of the transfer nip in the range which contains the solid dots was measured through the above described method. They are less than 0.5 mm. Thus, in the case of the width (NW) of the nip being very small, the contact pressure is uneven with respect to the longitudinal direction of the transfer roller, and vertical stripe-like non-uniformity and density difference tends to appear. On the other hand, the transfer material conveying belt 1 and the photosensitive drum 11 separate from each other by the distance corresponding to the thickness of the transfer material in the range which is outside the transfer material and in which the photosensitive drum 11 contacts directly to the transfer belt 1. Therefore, the transfer efficiency onto the transfer material conveying belt 1 reduces, and therefore, the transfer nip width (NW) further reduces. Therefore, the remainder amount of the toner on the transfer material conveying belt 1 after passing all the transferring station decreases.

<"G" (Hollow Dot)>

The hardness of the transfer roller 3 and the pressure of the transfer roller 3 are proper in the range which contains hollow dots in FIG. 8. As it described in Embodiment 1, the relation in the current between the paper-present-area and the paper-absent-area is maintained. Therefore, the image is satisfactory and the toner amount on the transfer material conveying belt after passing all the transferring stations is also reduced. The width (NW) of the transfer nip at this time is 0.5 mm-1.5 mm.

<"F" (Triangle Mark Area)>

It is satisfactory in the image on paper in the range which contains triangle marks in FIG. 8. However, there is slightly much amount of the toner which remains on the transfer material conveying belt 1. The reason therefor is that 1.5 to 2.0 mm of transfer nip width (NW) is slightly too large, and therefore, the transferring pressure is sufficiently high in the area outside of the transfer material also in the region in which the photosensitive drum 11 and the transfer belt 1 contact directly with each other.

On the other hand, since the transferring pressure in the paper-present-area is also sufficiently high, the setting of the transfer bias voltage is slightly low.

On the other hand, since the transferring pressure in the paper-present-area is also sufficiently high, the setting of the transfer bias voltage is slightly low.

As a result, the difference between the optimal transfer bias voltages for the transfer material and the transfer material conveying belt is small. Even if the transfer bias voltage is set to the optimal voltage for the transfer material, the abnormal discharge does not occur in the transfer-material-absent-area. In addition, the reverse-transfer of the toner does not occur. Moreover, since the amount of the toner transferred by the transferring pressure onto the belt is large, the remainder amount of the toner on the belt after passing all the transferring stations is large.

<"N" (Cross Mark Area)>

In the range which contains x in FIG. 8, the transferring by the pressure is powerful, and the toner is easy to transfer on the belt. In addition, the reverse-transfer in the downstream station does not occur, either. Therefore, the toner amount and the amount of remaining toner on the belt which are transferred on the transfer material are almost equal. This increases the load of the downstream cleaning means remarkably.

On the basis of the above-described result, as shown by hollow dots in FIG. 8 in this embodiment, the width (NW) of the contact nip between the photosensitive drum 11 and the transfer belt 1 is set to 0.5 mm-1.5 mm. In other words, the following is satisfied:

$0.5\ \text{mm} \leqq NW \leqq 1.5\ \text{mm}$.

In this manner, the high image quality of the image on the transfer material transferred can be maintained. And, simultaneously, the load of the cleaning means 20 for the transfer belt 1 is reduced, and after carrying out the marginless print mode, it is not necessary to add the special cleaning operation. In addition, it is not necessary to provide an additional cleaning means for the edge portion where the remainder amount of the toner on the belt is particularly large.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 029744/2008 filed Feb. 8, 2008 which is hereby incorporated by reference.

What is claimed is:

1. An image forming apparatus, comprising:

a transfer material feeding member for feeding a transfer material;

a first image bearing member for carrying a first toner image;

a second image bearing member, provided downstream of said first image bearing member with respect to a feeding direction of said transfer material feeding member, for carrying a second toner image;

a first transfer member for transferring the first toner image carried on said first image bearing member onto a transfer material; and a second transfer member, provided downstream of said first transfer member with respect to the feeding direction, for transferring the second toner image carried on said second image bearing member onto the transfer material, wherein said apparatus is operable in a marginless print mode in which the first toner image is formed on a first region on said first image bearing member corresponding to a size of the transfer material and a second region on said first image bearing member outside said first region, and wherein a reverse-transfer efficiency $TR1=(P2/P1)\times 100$ (%) and a reverse-transfer efficiency $TR2=(E2/E1)\times 100$ (%) satisfy:

$TR1<TR2$ where the reverse-transfer efficiency TR1 is a percentage of a mass P2 ($g/cm^2$), per unit area, of toner back-transferred from the transfer material onto said second image bearing member by said second transfer member to a mass P1 ($g/cm^2$), per unit area, of toner transferred from said first region onto the transfer material by said first transfer member, and where the reverse-transfer efficiency TR2 is a percentage of a mass E2 ($g/cm^2$), per unit area, of toner back-transferred from said transfer material feeding member onto said second image bearing member by said second transferring means to a mass E1 ($g/cm^2$), per unit area, of toner transferred from said second region onto said transfer material feeding member by said first transfer member.

2. A image forming apparatus according to claim 1, wherein a transfer efficiency $TRP1=(P1/P0)\times 100(\%)$ which is a percentage of P1 to a mass P0 ($g/cm^2$), per unit area, of the toner carried by said first image bearing member, and a transfer efficiency $TRE1=(E1/P0)\times 100(\%)$ which is a percentage of E1 to the mass P0 ($g/cm^2$), per unit area, of the toner carried by said first image bearing member, satisfy:

$TRP1>TRE1$.

3. An image forming apparatus according to claim 1, wherein a volume resistivity of said first transfer member and a volume resistivity of said transfer material feeding member are lower than a volume resistivity of the transfer material.

4. A image forming apparatus according to claim 1, wherein a width NW of a contact area between said second image bearing member and said transfer material feeding member, and of a contact area between said first image bearing member and said transfer material feeding member, measured in the feeding direction, satisfy:

$0.5\ \text{mm} \leqq NW \leqq 1.5\ \text{mm}$.

* * * * *